United States Patent [19]

Wolff et al.

[11] Patent Number: 4,596,651

[45] Date of Patent: Jun. 24, 1986

[54] TWO-STAGE TAR SANDS EXTRACTION PROCESS

[75] Inventors: William F. Wolff, Park Forest; James S. Patterson, Naperville, both of Ill.

[73] Assignee: Standard Oil Company (Indiana), Chicago, Ill.

[21] Appl. No.: 459,182

[22] Filed: Jan. 19, 1983

Related U.S. Application Data

[62] Division of Ser. No. 122,877, Feb. 20, 1980, abandoned.

[51] Int. Cl.[4] ..... C10G 1/00; C10C 1/18; C10C 3/08

[52] U.S. Cl. ..... 208/390; 208/45

[58] Field of Search ..... 208/11 LE, 8 LE, 45

[56] References Cited

U.S. PATENT DOCUMENTS 3,475,318 10/1969 Gable et al. ..... 208/11 LE
3,779,902 12/1973 Mitchell et al. ..... 208/11 LE
3,867,275 2/1975 Gleim et al. ..... 208/8 LE
3,941,679 3/1976 Smith et al. ..... 208/11 LE

FOREIGN PATENT DOCUMENTS 816689 7/1969 Canada ..... 208/11 LE

OTHER PUBLICATIONS

Mitchell et al., "Hydrocarbon Solvents," Fuel, vol. 52, pp. 149–152, (1973).

*Primary Examiner*—Andrew H. Metz
*Assistant Examiner*—Chung K. Pak
*Attorney, Agent, or Firm*—James R. Henes; William T. McClain; William H. Magidson

[57] ABSTRACT

A process for extracting bitumen from tar sands comprises a two-stage extraction wherein both specific and non-specific solvents are used to obtain a bitumen product low in fines and asphaltenes.

28 Claims, No Drawings

TWO-STAGE TAR SANDS EXTRACTION PROCESS

This is a division of application Ser. No. 122,877, filed Feb. 20, 1980, now abandoned.

BACKGROUND

There is an urgent need for orderly development of additional sources of hydrocarbon if the national goal of energy independence is to be reached. One of the possible sources for at least a portion of our energy needs is tar sands, which are a consolidated mixture of bitumen (tar) and sand. The bitumen consists of a mixture of a variety of hydrocarbons and, if properly separated from the sand component, can be used as a feedstock for the production of synthetic fuels and/or petrochemicals. For example, the tar sand deposits of the intermountain region of the western United States have an estimated reserve of more than twenty-eight billion barrels of oil in place. Although this resource is only a small fraction of the total U.S. oil requirement, it could be an important source of hydrocarbons on a regional basis.

The nature of tar sands varies greatly depending upon their geographical source insofar as certain tar sand deposits are more easily processed than others. For example, Athabasca tar sands from Alberta, Canada, have an average bitumen content of 12–13 weight percent and a relatively high moisture content of about 3–5 weight percent. It is believed that these tar sands consist of aggregates of sand, wherein each grain of sand is surrounded by a film of connate water, which separates the bitumen from the sand grains. This structure permits easier separation on a larger scale. In fact, commercial hot water extraction processes for recovering bitumen from Athabasca tar sands presently exist. A good review of the Alberta tar sands projects is presented in an article entitled "Tar Sands: A New Fuels Industry Takes Shape," Science, Vol. 199, page 756 (February 1978).

On the other hand, those deposits of tar sands found in the intermountain region of the United States have an average of less than about 10 weight percent bitumen and negligible amounts of connate water, hence the bitumen is in direct contact with the grains of sand. This situation makes recovery much more difficult. Examples of such tar sands include the Sunnyside and Asphalt Ridge deposits found in Utah. A further type of tar sand found mostly in California is the diatomaceous earth type, which contains up to about 25 weight percent bitumen. In this type of deposit the bitumen is contained within the very fine pores of the matrix and consequently is very difficult to extract. It also yields a large amount of fines upon extraction.

In addition to a variety of aqueous extraction processes as just mentioned, other extraction processes have been disclosed which, among other features, use different solvents. For example, U.S. Pat. No. 3,941,679 discloses the use of trichlorofluoromethane as an extraction solvent. U.S. Pat. No. 4,036,732 discloses the use of paraffinic hydrocarbons having from 5 to 9 carbon atoms. U.S. Pat. No. 4,046,663 teaches the use of a naphtha/methanol solvent system.

In selecting a solvent system for tar sands extraction, a number of factors must be considered in evaluating performance. Of course the most obvious factor is the effectiveness of the solvent in separating the bitumen from the sand. This is often counterbalanced by a second consideration, however, which is the asphaltene content of the recovered bitumen. Asphaltenes are complex high molecular weight materials which are undesirable for subsequent refining processes. In this regard, an article entitled, "The Solubility of Asphaltenes in Hydrocarbon Solvents," by D. L. Mitchell and J. G. Speight, Fuel, Vol. 52, pp. 149–152 (1973), extensively explores the solubility of asphaltenes for over fifty different solvents and blends.

A third factor of importance is the fines or mineral particle content of the extracted bitumen. Fines initially present in the tar sands as well as fines formed during grinding operations in preparation for extraction pose difficult separation problems. The rate at which the fines settle is to a large extent dependent upon the solvent used and has been thought to be primarily determined by the density and viscosity of the solvent.

SUMMARY OF THE INVENTION

It has now been discovered that the yield and quality of the bitumen product by tar sands extraction can be greatly enhanced by treating the tar sands or bitumen in stages with at least one nonspecific solvent and at least one specific solvent. The primary benefit of treating tar sands in accordance with this invention is producing a bitumen product which has a very low content of asphaltenes and fines. Fines are particularly detrimental to bitumen quality because of their adverse affect on subsequent refining operations, particularly in regard to fixed bed catalytic processes and handling due to plugging and settling problems.

For purposes herein, a "nonspecific solvent" is any solvent capable of dissolving all of the bitumen components, including the asphaltenes. Suitable nonspecific solvents include, without limitation, the haloethanes such as chloroethane; the halomethanes, such as dibromodifluoromethane, chlorofluorocarbons, chloroform, carbon tetrachloride, etc.; cyclic hydrocarbons, such as benzene, toluene, and methyl cyclohexane; and aromatic petroleum fractions, which can be a very economical source of solvent. Preferred nonspecific solvents include the chloromethanes, such as methylene chloride, and the chlorofluorocarbons such as trichlorofluoromethane* (sometimes referred to herein as "TCFM"). A "specific solvent," on the other hand, is one which will not dissolve all of the bitumen components, notably the asphaltenes, and suitably includes the $C_4$–$C_7$ alkanes and corresponding petroleum fractions. Preferred specific solvents include isopentane and hexane because they boil at low temperatures and are easy to recover and are low in cost. "Asphaltenes" are defined as toluenesoluble solids which are insoluble in n-pentane at high dilutions. "Fines" are defined as particulate mineral solids having a particle size of less than about 400 mesh (37 microns).

*Trichlorofluoromethane is commonly known as Freon-11 and has been used extensively in this experimentation. Other Freons are also suitable, however.

Broadly, the invention resides in a method for extracting bitumen from tar sands comprising initially contacting the tar sand with either a non-specific solvent or a specific solvent in a first extraction stage and thereafter contacting the bitumen with both a nonspecific solvent and a specific solvent in a second extraction stage, whereby a bitumen product low in asphaltenes and fines is obtained. The invention is manifested in several embodiments.

In one aspect of this invention, which has been termed "staged addition," the order in which the non-specific and specific solvents are used is dependent upon the nature of the tar sand being processed. More particularly, those tar sands containing 3 weight percent connate water or more, such as Athabasca tar sands, give best results by having initial contact with a specific solvent in a first stage followed by treatment with a nonspecific solvent in a second stage. On the other hand, just the opposite is the case for those tar sands containing less than 3 weight percent connate water, such as Sunnyside or Asphalt Ridge tar sands.

Hence, in one aspect of the invention resides in a method for extracting bitumen from tar sands having at least 3 weight percent connate water comprising: (a) slurrying the tar sands with a specific solvent to dissolve a substantial portion of the available bitumen; (b) adding a nonspecific solvent to the slurry to dissolve additional available bitumen; (c) separating the bitumen-containing solvents from the slurry solids; and (d) recovering the bitumen from the separated bitumen-containing solvents.

In the alternative, the invention resides in a method for extracting bitumen from tar sands having less than 3 weight percent connate water comprising: (a) slurrying the tar sands with a nonspecific solvent to dissolve a substantial portion of the available bitumen; (b) adding a specific solvent to the slurry to precipitate the asphaltenes and fines; (c) separating the bitumen-containing solvents from the slurry solids; and (d) recovering the bitumen from the separated bitumen-containing solvents.

In a further aspect, which can be termed "staged addition with sand separation," the invention resides in a method for extracting bitumen from tar sands comprising: (a) slurrying the tar sands with a nonspecific solvent to dissolve a substantial portion of the available bitumen; (b) separating the dissolved bitumen-containing solvent from the slurry solids (sand); (c) contacting the bitumen-containing solvent with a specific solvent to precipitate asphaltenes and fines; (d) separating the fines and asphaltenes from the bitumen-containing solvents; and (e) recovering the bitumen from the bitumen-containing solvents.

In still another aspect, which can be termed "staged addition with solvent evaporation," the invention resides in a method for extracting bitumen from tar sands comprising: (a) slurrying the tar sands with a nonspecific solvent to dissolve a substantial portion of the available bitumen; (b) evaporating or flashing about 80 to about 95 percent of the solvent to form a bitumen-containing residue; (c) slurrying the bitumen-containing residue with a specific solvent to dissolve the bitumen while precipitating the asphaltenes and fines; (d) separating the bitumen-containing solvent from the slurry solids; and (e) recovering the bitumen from the solvent. It is preferable to leave behind from about 5 to about 20 percent of the non-specific solvent when evaporating the non-specific solvent in the first stage, since its combination with the specific solvent gives a preferred solvent, and as some solvent is necessary for easier handling of the bitumen.

In all aspects of this invention, it is preferable that the extractions be conducted at about ambient temperature insofar as such temperatures are most convenient when operating on a commercial scale. Elevated temperatures can be used, however, with an attendant increase in the rate of extraction.

The amounts of solvents used can vary greatly depending upon the yield of bitumen desired. Generally, higher ratios of non-specific solvent to bitumen will increase the yield of bitumen extracted. However, using the methods of this invention, it is unnecessary to use a total solvent:bitumen ratio greater than about 25:1 or less than about 2:1 and preferably in the range of about 4:1 to about 20:1. The same limits hold for both the first and second extraction stages.

The residence times for extraction are also dependent upon the economics of the process and are not a critical variable. It is preferred that the first stage extractions be carried out for such time as is necessary to achieve dissolution of a substantial portion of the available bitumen, i.e., at least about 60 percent. The second stage residence times will generally be shorter since the major portion of the bitumen has been dissolved at that point in the process. In general, however, the residence time for the first stage can vary anywhere from about 10 minutes to about 24 hours, preferably not longer than 1 hour and most preferably not longer than 30 minutes. Settling times to remove fines will generally be longer than the extraction times, but can vary greatly with the tar sand feed and particular solvents being used.

Separation of the bitumen-containing solvent(s) from the slurry solids can be accomplished in any of several methods well known in the art, such as settling, filtration, centrifugation, or combinations of these.

Likewise, recovery of the bitumen from the bitumen-containing solvents can also be accomplished by well known methods such as fractionation.

EXAMPLES

The following examples will illustrate the various aspects of the invention in more detail.

EXAMPLE 1 (STAGED ADDITION)

In these runs we used (with but one exception) a total of 30 g. solvent together with either 20 g. Athabasca tar sand, 20 g. Sunnyside tar sand, or 30 g. Asphalt Ridge tar sand. All runs were with trichlorofluoromethane (TCFM) and/or isopentane (referred to herein as i-$C_5$) as solvents, and in all mixtures or staged additions equal weights of TCFM and i-$C_5$ were used. The solvent and tar sand were contacted in a 50-ml. graduate tumbled end-over-end at about 60 cycles per minute. In all runs the mixtures were contacted for a total of 30 minutes, but in the staged runs with Athabasca and Asphalt Ridge tar sands the tar sand and the first of the solvent components were contacted for fifteen minutes, after which the second component was added and the contacting continued for the second 15 minutes. With the Sunnyside tar sand, on the other hand, a twenty minute first stage was followed by a ten minute second stage. After the tumbling was completed, the graduates were allowed to stand undisturbed for a day or more. The fines level was followed visually to determine half-setting times ($t_{\frac{1}{2}}$=the time required for half the supernatant liquid to clarify), and the clarified liquid was analyzed to determine bitumen yields and product quality (as measured by fines and asphaltene concentrations).

TABLE I

STAGED ADDITION OF SOLVENTS

| Tar Sand | Solvents: First (or only) Stage | Solvents: Second Stage | $t\frac{1}{2}$ minutes | Bitumen extracted, Wt % | Bitumen Quality: % Fines | Bitumen Quality: % Asphaltenes |
|---|---|---|---|---|---|---|
| Athabasca | TCFM | None | 20 | 90 | 6.0 | 9.6 |
| Athabasca | TCFM + i-$C_5$ | None | 5 | 86[a] | .2 | .9 |
| Athabasca | TCFM | i-$C_5$ | 5 | 68 | 1.3 | 1.3 |
| Athabasca | i-$C_5$ | TCFM | 2 | 88 | .6 | .8 |
| Athabasca | i-$C_5$ | None | 1.4 | 80 | .3 | .3 |
| Asphalt Ridge | TCFM + i-$C_5$ | None | 8 | 91 | .3 | .2 |
| Asphalt Ridge | TCFM | i-$C_5$ | 14 | 97 | .1 | .3 |
| Asphalt Ridge | i-$C_5$ | TCFM | 8[b] | 88 | .2 | .2 |
| Sunnyside | TCFM + i-$C_5$ | None | 4[c] | 81 | .3 | .1 |
| Sunnyside | TCFM | i-$C_5$ | 5 | 85 | .2 | .1 |
| Sunnyside | i-$C_5$ | TCFM | 3[c] | 74 | .2 | .1 |

[a]Better of two results
[b]Average value; $t\frac{1}{2}$ dropped from 11 minutes to 5 minutes as settling proceeded.
[c]Average of two determinations Inspection of the Athabasca results shows that the staged addition of first isopentane (specific) and then TCFM (non-specific) gives particularly promising results. The yield approaches that obtained with straight TCFM, and the settling time and product quality approach those for isopentane alone. The surprising thing about the results for this procedure is the considerable improvement in fines settling rate relative to that for the premixed solvent; the $t\frac{1}{2}$ values differ by more than a factor of two. The decrease in fines settling rate on adding the solvents in reverse order (TCFM first) is also surprising, but not advantageous.

With the Asphalt Ridge and Sunnyside tar sands (less than 3 weight percent connate water) the same settling pattern is observed, but the advantage of the higher bitumen yield is obtained by staged addition in the reverse order (TCFM first). Although the fines-settling rate is poor, it is believed to be very much better than that for TCFM alone. Hence the order in which the solvents are introduced plays a critical role in the effectiveness of the extraction, depending upon the nature of the tar sand being extracted (connate water content).

EXAMPLE 2

As an example of of the applicability of our process to diatomaceous earth tar sands, 20 g. California diatomaceous earth tar sands in about $\frac{1}{8}$" lumps, 20 g. lead shot, and 20 g. methylene chloride were added to a 100 ml stoppered graduate. The mixture was then tumbled by rotating the graduate end over end for 15 minutes at a rate of about 30 revolutions per minute. At the end of this time 20 g. isopentane was added to the mixture and after two minutes standing the supernatant liquid and fines were removed by decantation onto a filter. Additional portions of isopentane were added and decanted until all the fines had been washed onto the filter. The entire filtration proceeded very rapidly to give 72% of the tar sand bitumen in the filtrate and 2.86 g. fines on the filter.

EXAMPLE 3 (STAGED ADDITION WITH SAND SEPARATION)

In these runs, 30 g. Sunnyside tar sand was contacted with 45 g. "solvent-1" for 30 minutes. The product was allowed to settle for 30 mintues and then an aliquot of this first supernatant liquid was withdrawn, analyzed, and mixed with an equal weight of "solvent-2." The mixture was tumbled for 15 minutes and then allowed to settle for 24 hrs. or more, after which a portion of this second supernatant liquid was analyzed. Inasmuch as the staging results from Example 1 show a preference for initial addition of a nonspecific solvent in extractions of tar sands that do not contain connate water, a nonspecific solvent was used as "solvent-1" and a specific solvent was used as "solvent-2." The results obtained in four runs of this type are summarized in Table III.

TABLE III

STAGED ADDITION WITH SAND SEPARATION (Sunnyside Tar Sand)

| "Solvent-1" | First Aliquot: % Bitumen Extracted[a] | First Aliquot: Bitumen Quality % Fines | First Aliquot: Bitumen Quality % Asphn. | "Solvent-2" | Second Aliquot: % Bitumen Extracted[a] | Second Aliquot: Bitumen Quality % Fines | Second Aliquot: Bitumen Quality % Asphn. |
|---|---|---|---|---|---|---|---|
| TCFM | 81 | 30 | 1.2 | Hexanes[b] | 83 | .7 | .7 |
| TCFM | 73 | 29 | 4.3 | Isopentane[c] | 89 | .4 | 1.8 |
| $CH_2Cl_2$ | 63 | 6.7 | .8 | Hexanes | 67 | 1.0 | .4 |
| $CH_2Cl_2$ | 74 | 6.2 | .8 | Iospentane | 61 | 1.2 | 1.5 |

[a]Percent of total available bitumen taken into solution.
[b]Commercial grade hexane.
[c]Isopentane was added in excess to obtain a system containing 60 percent isopentane and 40 percent TCFM.

From these results we see that commercial grade hexanes behave much like isopentane when used in conjuction with either TCFM or methylene chloride ($CH_2Cl_2$). Both of these specific solvents give sharp reductions in the amount of unsettled fines, and down to about the same level for a given nonspecific solvent. (The higher final yields obtained with TCFM as the nonspecific solvent could reflect the fact that 50—50 mixtures seem to be about optimum for TCFM systems, but not necessarily so for methylene chloride systems.)

In addition to the results given in Table III, half-settling times ($t\frac{1}{2}$) were also determined for both the first settling (with just the nonspecific solvent present) and the second settling (with both solvents present). These values are given in Table IV.

TABLE IV

STAGED ADDITION WITH SAND SEPARATION; HALF-SETTLING TIMES

| "Solvent-1" | First settling; $t_{\frac{1}{2}}$, minutes | "Solvent-2" | Second settling; $t_{\frac{1}{2}}$, minutes |
|---|---|---|---|
| TCFM | 500 | Hexanes | 2 |
| TCFM | 400 | Isopentane | 4 |
| $CH_2Cl_2$ | 17 | Hexanes | 2 |
| $CH_2Cl_2$ | 14 | Isopentane | 2 |

Here the great increase in solids settling rates obtained after addition of the specific solvent is clearly demonstrated. The results indicate that the commercial grade hexane is at least as good as isopentane in this respect.

EXAMPLE 4 (STAGED ADDITION WITH SOLVENT EVAPORATION)

A Sunnyside tar sand sample was slurried with TCFM solvent at a 10:1 solvent:bitumen weight ratio. The slurry was allowed to settle by gravity and centrifuged. The solvent was then completely evaporated (flashed) under mild heat and vacuum. (From a commercial standpoint, however, it is desirable to leave between 5–20 percent of the solvent to maintain suitable handling characteristics.) The resulting bitumen was then resolvated with a 50—50 mixture of TCFM and isopentane at a solvent:bitumen weight ratio of 10:1. Fines and separated asphaltenes were removed by gravity settling and centrifugation. The solvent was removed by evaporation to yield a deasphaltened bitumen product.

The bitumen product so obtained was subjected to a visbreaking procedure. For comparison, the bitumen sample obtained from a mixed solvent extraction of the same tar sand was also subjected to visbreaking. In preparing the mixed solvent bitumen sample, a 50:50 mixture of isopentane and i-$C_5$ was added to the tar sand in a 10:1 weight ratio of solvent to bitumen. Minerals and asphaltene constituents were separated by gravity settling followed by centrifugation. The extract was then heated at low temperature under vacuum to drive off the TCFM/i-$C_5$ solvent to recover the bitumen. Evaporation was carried out under a nitrogen blanket to minimize ambient-oxidative effects.

The visbreaking test procedure for the two comparative samples was carried out as follows:

Feed was charged to the reactor, the reactor and condenser connected to the system, and the system pressure tested. The amount of feed ranged from about 14 to 30 grams. The system was purged with nitrogen and a flow rate established through the shutoff valve, not through the reactor. After a constant flow was established (ca. 0.00011 $ft^3$/min to 0.001 $ft^3$/min) the salt bath heater was raised into position. Normally, when the reactor temperature reached 200° F. the shutoff valve was closed and gas started flowing through the reactor. On immersion of the reactor into the salt bath, the temperature downstream of the reactor reached 750° F. and remained there until the end of the run (5.5 to 10 minutes).

During the reaction, all gases are carried overhead by nitrogen sweep. Most of the pentane-plus material was removed from gas in the condenser. All other gas passed through the gas sample bomb and finally into the wet test meter. On removal of the salt bath, reaction was quenched by immersing the reactor in an ice bath. Total soaking time was then calculated based on total time for the reactor to reach 750° F. during quench. The results are tabulated in Table V.

TABLE V

VISBREAKING PRODUCT QUALITY COMPARISON

| | Staged Addition With Solvent Evaporation | Mixed Solvent | |
|---|---|---|---|
| Pressure | 301 | 302 | 302 |
| Temperature | 839.5 | 826.6 | 848.9 |
| Soaking Time, Minutes | 5.8 | 7.3 | 7.3 |
| Product Composition, Wt. % | | | |
| IBP-360° F. | 11.4 | 0 | 0 |
| 360–650° F. | 32.5 | 7.6 | 11.4 |
| 650–1000° F. | 37.8 | 22.1 | 27.7 |
| 1000+ °F. | 18.3 | 70.3 | 60.9 |

These results show a substantial difference in the nature of the product composition depending on the method from which the starting bitumen sample was extracted. The bitumen sample obtained by staged addition yields a much greater percentage of products having a lower boiling point. This is an unexpected result.

It will be apparent to those skilled in the art that many variations from the foregoing examples, shown only for purposes of illustration, can be made without departing from the scope of this invention.

We claim:

1. A method for extracting bitumen from tar sands, wherein the tar sands contain at least 3 weight percent connate water, comprising initially contacting the bitumen with a specific solvent in a first extraction stage and thereafter contacting the bitumen with both a nonspecific solvent and a specific solvent in a second extraction stage, whereby a bitumen product low in asphaltenes and fines is obtained.

2. A method for extracting bitumen from tar sands wherein the tar sands have at least 3 weight percent connate water, comprising:

(a) slurrying the tar sands with a specific solvent to selectively dissolve a substantial portion of the available bitumen;

(b) adding a nonspecific solvent to the slurry to dissolve additional available bitumen;

(c) separating the bitumen-containing solvents from the slurry solids; and (d) recovering the bitumen from the separated bitumen-containing solvents.

3. The method of claim 2 wherein the tar sands is Athabasca tar sands.

4. The method of claim 2 wherein the specific solvent is selected from the group consisting of $C_4$–$C_7$ alkanes and corresponding petroleum fractions.

5. The method of claim 4 wherein the specific solvent is isopentane.

6. The method of claim 2 wherein the nonspecific solvent is selected from the group consisting of haloethanes, halomethanes, cyclic hydrocarbons, and aromatic petroleum fractions.

7. The method of claim 6 wherein the nonspecific solvent is methylene chloride or trichlorofluoromethane.

8. The method of claim 2 wherein the weight ratio of total solvent to bitumen is from about 2:1 to about 25:1.

9. The method of claim 2 wherein the tar sands are slurried with a specific solvent at about ambient temperature.

10. The method of claim 9 wherein the nonspecific solvent is selected from the group consisting of haloethanes, halomethanes, cyclic hydrocarbons, and aromatic petroleum fractions.

11. The method of claim 10 wherein the nonspecific solvent is methylene chloride or trichlorofluoromethane.

12. A method for extracting bitumen from tar sands, wherein the tar sands contain less than 3 weight percent connate water, comprising:

(a) initially slurrying the tar sand with a nonspecific solvent to dissolve a substantial portion of the available bitumen in a first extraction stage;

(b) separating the bitumen-containing solvent from the slurry solids;

(c) contacting the bitumen-containing solvent with a specific solvent to precipitate asphaltenes and fines in a second extraction stage;

(d) separating the fines and asphaltenes from the bitumen-containing solvents; and (e) recovering the bitumen from the solvents.

13. The method of claim 12 wherein the tar sands are obtained from Asphalt Ridge, Sunnyside, or diatomaceous earth deposits.

14. The method of claim 12 wherein the specific solvent is selected from the group consisting of $C_4$–$C_7$ alkanes and corresponding petroleum fractions.

15. The method of claim 14 wherein the specific solvent is isopentane.

16. The method of claim 12 wherein the nonspecific solvent bitumen weight ratio is at least about 2:1.

17. The method of claim 12 wherein the specific solvent:bitumen weight ratio is at least about 2:1 to about 25:1.

18. The method of claim 12 wherein the tar sands are slurried with the nonspecific solvent at about ambient temperature.

19. A method for extracting bitumen from tar sands, wherein the tar sands contain less than 3 weight percent connate water, comprising:

(a) initially slurrying the tar sands with a nonspecific solvent to dissolve a substantial portion of the available bitumen in a first extraction step;

(b) evaporating from about 80 to about 95 percent of the solvent to form a bitumen-containing residue;

(c) slurrying the bitumen-containing residue with a specific solvent to dissolve the bitumen and precipitate the asphaltenes and fines in a second extraction step;

(d) separating the bitumen-containing solvent from the slurry solids; and (e) recovering the bitumen from the solvent.

20. The method of claim 19 wherein the nonspecific solvent is selected from the group consisting of haloethanes, halomethanes, cyclic hydrocarbons, and aromatic petroleum fractions.

21. The method of claim 20 wherein the nonspecific solvent is methylene chloride or trichlorofluoromethane.

22. The method of claim 19 wherein the specific solvent is selected from the group consisting of $C_4$–$C_7$ alkanes and corresponding petroleum fractions.

23. The method of claim 22 wherein the specific solvent is isopentane.

24. The method of claim 19 wherein the nonspecific solvent:bitumen weight ratio is at least about 2:1 to about 25:1.

25. The method of claim 19 wherein the total solvent:bitumen weight ratio is from about 2:1 to about 25:1.

26. The method of claim 19 wherein the tar sands are slurried at about ambient temperature.

27. The method of claim 19 wherein the nonspecific solvent is evaporated by flashing.

28. The method of claim 19 wherein the tar sands are obtained from Asphalt Ridge, Sunnyside or diatomaceous earth deposits.

* * * * *